US005803276A

United States Patent [19]

Vogler

[11] Patent Number: 5,803,276

[45] Date of Patent: Sep. 8, 1998

[54] ADJUSTABLE SHELF DIVIDER

[76] Inventor: Michael N. Vogler, 49 Miranda Court, Thornhill, Ontario, Canada

[21] Appl. No.: 863,131

[22] Filed: May 27, 1997

[51] Int. Cl.[6] ..... A47F 5/00

[52] U.S. Cl. ..... 211/184; 108/60

[58] Field of Search ..... 108/60, 61; 211/184, 211/175

[56] References Cited

U.S. PATENT DOCUMENTS

| | | | |
|---|---|---|---|
| 154,940 | 9/1874 | Adams | 211/184 |
| 355,511 | 1/1887 | Danner | 108/61 |
| 1,714,266 | 5/1929 | Johnson | 211/184 X |
| 2,563,570 | 8/1951 | Williams | 211/184 X |
| 3,285,429 | 11/1966 | Propst | 211/184 |
| 3,497,081 | 2/1970 | Field | 211/184 |
| 3,501,020 | 3/1970 | Krikorian | 211/184 |
| 3,868,021 | 2/1975 | Heinrich | 211/184 |
| 4,314,700 | 2/1982 | Dylag | 108/60 X |
| 4,809,856 | 3/1989 | Muth | 211/184 |
| 5,341,945 | 8/1994 | Gibson | 211/184 |
| 5,381,908 | 1/1995 | Hepp | 108/61 X |
| 5,469,975 | 11/1995 | Fajnsztajn | 211/184 X |

*Primary Examiner*—Blair Johnson
*Attorney, Agent, or Firm*—William J. Daniel

[57] ABSTRACT

The present invention is a shelf divider for separating groups of products arranged on display shelves or the like and takes the form of a relatively thin vertical panel or partition which is self-maintained in upstanding condition on the shelf surface by laterally extending stabilizing feet adjacent each end and is preferably molded from tough, durable plastic. The partition is made of two (or more) co-planar sections interconnected in adjacent abutting pairs by at least one telescoping longitudinally extending mating elongated U-shaped tongue and slot connection permitting lengthwise adjustment of the sections to fit different shelving widths. The tongue and slot are held against lateral disengagement by shaping their proximate upper and lower edges as V-shaped (in cross-section) protrusions and grooves which mate together while permitting relative longitudinal movement of the sections. Free ends of the slotted section legs are fixed against vertical separation by small vertical straps attached at their ends to opposite sides of the slot legs and defining therebetween a vertically directed narrow channel slidably penetrated by the tongue of another section.

8 Claims, 2 Drawing Sheets

ADJUSTABLE SHELF DIVIDER

FIELD OF THE INVENTION

This invention relates to the field of mass marketing of goods and products and is concerned more particularly with the orderly arrangement for display to the purchasing customer of goods and products for sale.

BACKGROUND OF THE INVENTION

In many different retail sales operations, including grocery stores and markets, supermarkets, drug stores, variety shops, department stores, dry goods stores, and so on, goods and products are commonly displayed for sale on shelves, racks or similar supporting surfaces. Such surfaces can extend exposed for considerable distances in open-front cabinets or frames or can be enclosed within freezer cabinets or the like. For the convenience of the customer and to reduce the frequency of re-stocking to within manageable limits, where size permits, a considerable quantity of each different type or size of article is collected or clustered together on a certain designated region of the shelf or the like. The variety and number of different products that a typical retail stores is called upon to offer for sale can be staggering. Because the area of available shelf space is inherently fixed for a given facility, store management has a strong motivation to crowd the different types of products on shelves as closely together as possible. As a result, it is ofttimes difficult for a customer to ascertain where the collection of one product ends and that of another product begins. This identification problem can be complicated by the practice where the package or container structure is suitable of stacking products one upon another which can lead to articles being dislodged from the stack and toppling into the region designated for a different article.

In addition to creating irritation and delay for a prospective purchaser, this confusion over product location detracts from a neat and attractive marketing environment.

At least some degree of control over the problem of maintaining a reasonably defined and apparent separation between adjacent groups of different products or different sizes of the same product located on a sales display surface if some kind of division or separation were provided at the boundaries between the adjacent product groups. Because of the great number of boundary demarcations required for even moderately small stores, an acceptable divider would have to be of very low cost construction to be affordable and itself consume at little shelf space as possible. Since the boundaries or locations of product clusters are often shifted to accommodate new introductions, adjust for changing demand for an item or re-focus marketing emphasis, provision would have to be made for quick and easy adjustment of the divider location. And because the depth of storage shelves or surfaces can vary, it would be advisable for any divider to be capable of lengthwise extension over a reasonable distance.

SUMMARY OF THE INVENTION

The present invention is a shelf divider for separating groups of products arranged on display shelves or the like and takes the form of a relatively thin vertical panel or partition which is self-maintained in upstanding condition on the shelf surface by stabilizing feet adjacent each end is adapted to be produced at low cost preferably by molding from tough, durable plastic. The partition is constituted in two (or more) sections which are interconnected in adjacent pairs for lengthwise adjustment to accommodate to different shelving widths by a telescoping longitudinally extending rating elongated U-shaped tongue and slot connection, To insure permanent inter-engagement between the tongue and slot and prevent dislodgement under lateral stress or torsion, longitudinal surfaces along proximate edges along both the upper and lower edges of the tongue and slot are formed as V-shaped (seen in cross-section) protrusions and grooves which fit together in mating relation while permitting a section of each pair to move longitudinally relative to the other section. Vertical separation of free ends of the legs of a slotted section with possible consequential release of the tongue from the slot is prevented by short straps anchored at top and bottom to opposite side surfaces of the slot legs adjacent their free ends and defining therebetween a vertically directed narrow channel slidably penetrated by the tongue of another section.

BRIEF DESCRIPTION OF THE DRAWINGS

For visual perception of the structural details of illustrative embodiments of the invention, reference may be had to the accompanying drawings in which.

DETAILED DESCRIPTION OF ILLUSTRATIVE EMBODIMENTS

Figure 1:
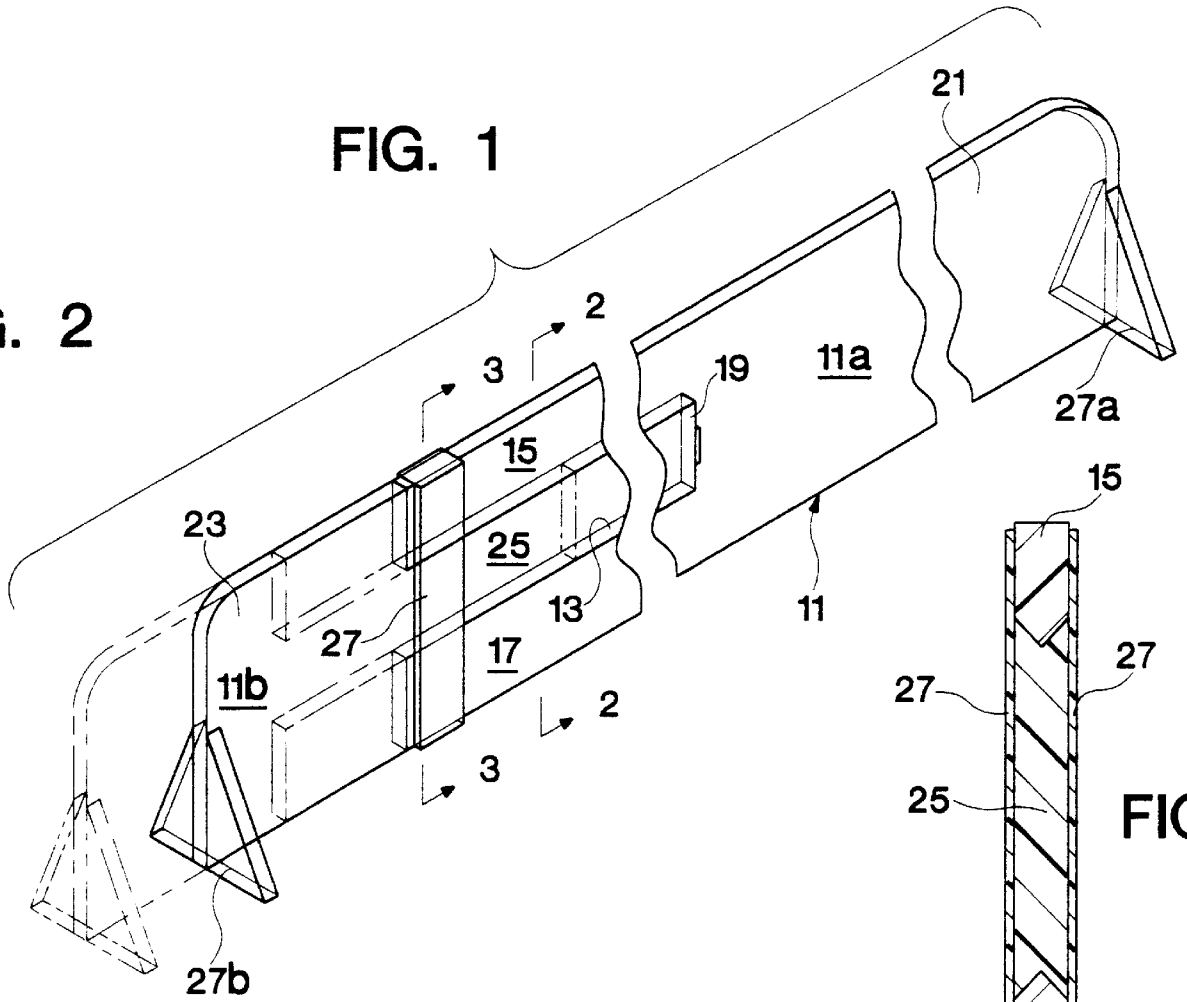
FIG. 1 is a side view in perspective of one embodiment of the divider of the invention having two sections joined by a longitudinally telescoping tongue and slot connection, the two sections being shown in fully telescoped condition in solid lines and in partially extended condition in broken lines.

An example of a simplified version of a shelf divider according to the invention is shown in perspective in FIG. 1. The divider includes a vertically upstanding partition panel generally designated 11 of a height or vertical extent which can be varied as needed for a particular marketing requirement. As shown, the divider partition has a height of about two and one-quarter inches which is close to the minimum capable of serving as an effective divider and is quite suitable for many products, especially one intended to be arranged in a single layer on a display shelf. But greater heights can easily be selected if desirable as with products stacked in multiple layers.

The divider can be constructed of any suitable material preferably of a fairly stiffly resilient flexible nature for durability. While metal or even wood could conceivably be utilized, there are important advantages, for instance in cost both of material and mode of production, that can be achieved with a tough plastic or polymer that can be molded in high volume at quite low cost. A particularly suitable polymer is polycarbonate although other polymers such a acrylic or styrene derivatives, e. g. styrene acrylonitrile, could certainly be substituted. The polymer can be opaque or transparent, the latter being generally preferred for reasons of attractiveness.

Panel 11 is formed of at least two cooperating coplanar sections 11*a* and 11*b* joined at mutually adjacent inner ends by a telescoping longitudinal tongue and slot connection. To this end, one section, in this instance section 11*a* to the right in FIG. 1, although the orientation could equally well be reversed, is formed with a elongated U-shaped slot 13 opening from its inner (left) end and extending longitudinally toward an outer (right) end between two vertically separated parallel legs 15, 17. The length of slot 13 as a proportion of the total length of the section can be widely varied but as an example, a proportion of about 50% is shown. The base line of the slot can be perpendicular to its length, as shown as 19, but it could equally well be rounded or otherwise curved. Slotted section 11*a* has an end portion 21 that is uninterrupted, i. e. free of any slot, adjacent its outer end for reasonable structural integrity. However, the length of the uninterrupted end portion can be substantially reduced from that seen in the drawing. Thus, slot 13 could if desired be extended almost the entire length of section 11*a*, stopping far enough from the outer limit of that section to leave a short uninterrupted end portion.

The other section 11*b* includes a relatively short full height end portion 23 from which projects a longitudinally extending tongue 25 of reduced vertical extent at both top and bottom to make a snug slidable fit within slot 13 and of corresponding length. The vertical dimension of tongue 25, and thus of slot 13, is variable provided a reasonable degree of structural strength is imparted to the tongue and slot connection even when its parts are telescoped apart as far as permitted. As a rough rule of thumb, the vertical dimension of the tongue and individual legs is more or less about the same. In FIG. 1, the divider sections are shown in solid lines in fully telescoped condition with the inner ends thereof in abutting relation and in broken lines with section 11*b* carrying tongue 21 in partially extended position. Tongue 25 could be shorter than slot 13 but this would serve no purpose and reduce the extended length of the divider.

Figure 2:
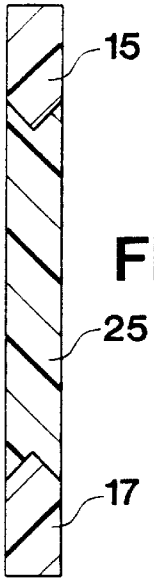
FIG. 2 is a transverse cross-sectional detail view taken along line 2—2 of FIG. 1 and showing the V-protrusion/groove engagement of top and bottom edges of the tongue and groove.

To insure that the tongue is securely retained within the slot, the mutually facing pairs of edges at both bottom and top of the tongue and slot are shaped for mating interengagement. For this purpose, as can be seen in FIG. 2, one edge of each pair (which can be on either the slot or tongue) configured (in cross-section) as a V-shaped groove which the other edge of the pair has a corresponding V-shaped projection. The fit between the edges of each pair (shown in rather idealized fashion in FIG. 2) should be close with at most little slack consistent with freely sliding relative movement therebetween.

Figure 3:
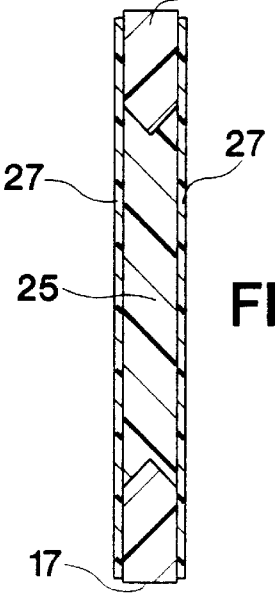
FIG. 3 is a transverse cross-sectional detail view taken along line 3—3 of FIG. 1 and showing the vertical retention strips for the free ends of the legs defining the slot.

Despite the fact that legs 15, 17 possess substantial resistance against movement within their own plane, it is nevertheless possible, particularly if enough stress should be applied to the divider sections while in maximally extended condition, for the legs to move apart slightly in their own plane enough to result in release of the groove and projection engagement between their mutually facing pairs of edges so that the two divider sections become separated. While such a separation in not fatal, it does necessitate re-insertion of the tongue into the slot and is an inconvenience. To eliminate this risk, small vertical reinforcement straps 27 are preferably affixed to the opposite sides of legs 15, 17 adjacent the free ends of the legs by e. g. heat fusion, adhesive or other suitable means of attachment. In FIG. 1, the strap on the remote side of the divider has been omitted to avoid confusion but both straps can be seen in the cross-sectional view of FIG. 3. As is evident in both views, straps 27 bridge the clearance between the two legs and define between them a narrow vertical channel for reception of tongue 25 while preventing the ends of legs 15, 17 from being forced apart within their own plane.

Adjacent the opposite or outer ends of the divider (although other locations are possible) are laterally extending feet 27*a*, 27*b* one on each of the two divider sections. The feet contact the shelf or other supporting surface along their lower edges and extend laterally to either side of the plane of the divider a length sufficient to hold the divider panel as a whole stably in an erect position. This length will depend on the height of the panel. For the example having a height of about 2¼ inches, a foot having a total maximum lateral dimension of about one inch is satisfactory but should obviously be greater for higher panels. One can easily determine by simple trial and error what base length is required for a panel of increased height. The feet can have a variety of shapes. Side arms defining with the panel an inverted "T" in end elevation would serve the purpose but might be susceptible to breakage. Another simple and more preferred design is a triangle, e, g, an isosceles triangle, affixed in perpendicular relation to the outer corner of each of the end portions 21, 23 of the respective divider sections with the triangle base resting on the supporting shelf surface. The feet in an event can be (and preferably are) molded integrally with the corresponding sections or can be formed separately and attached with adhesive or other means.

The bottom supporting edges of the divider feet can lie in a common plane with the lowermost edges of the two divider sections, as is the case for the embodiment of FIG. 1. Alternatively, they can project somewhat vertically beyond the lower divider edges, thereby elevating the divider to hold its bottom edge clear of the supporting surface.

Figure 5:
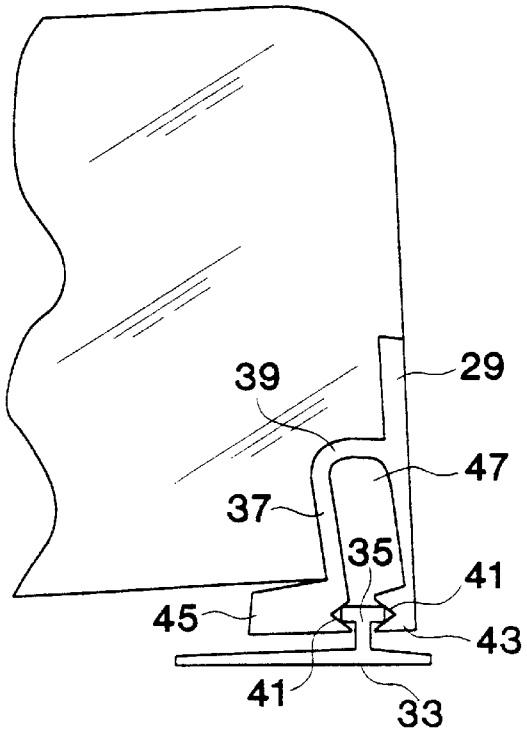
FIG. 5 is an enlarged side view of the portion of FIG. 4.
Figure 4:
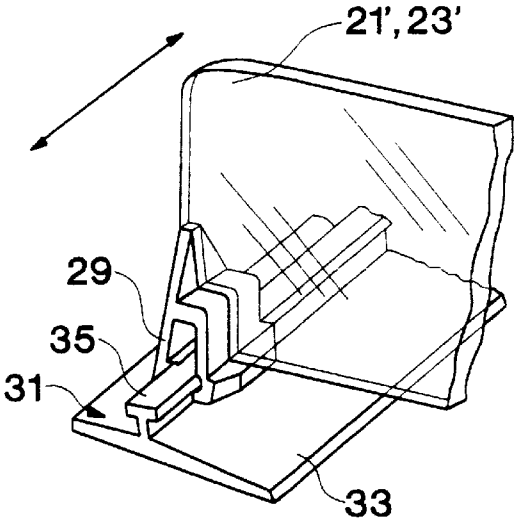
FIG. 4 is an enlarged fragmentary perspective view of an end portion of one (either) section of a modified embodiment of the divider in which stabilizing feet maintaining the divider upright are formed with a downwardly opening laterally extending inverted generally U-shaped groove adapted for resilient engagement with a rail of an elongated lateral adjustment track for easy sideways adjustment of the divider position.

An example of a modified configuration for the stabilizing feet illustrating the latter alternative appears in FIGS. 4 and 5. wherein there is shown only one of the feet, the other being a mirror image. Here, the foot 29 retains the original triangular contour but projects downwardly below the limit of the divider. In addition, foot 29 is developed three-dimensionally for cooperation with a separate elongated laterally extending track generally designated 31. In certain instances, the shelving with which the divider of the invention is intended to be employed does not take the form of a solid continuous surface but is rather constituted of a kind of open grid formed, e. g. of array of parallel wires affixed at opposite ends and at one or more intermediate points to frame members intersecting with the wire array. Such grids are frequently used in freezer cabinets in order to permit free circulation of chilled air from top to bottom of the cabinet. They do not, however, furnish firm consistent support for dividers having feet of the types shown.

This problem is solved by providing for association with the divider the elongated track 31 which is adapted to be arranged on a grid-type shelf over and in crossing relation to the length of the grid wires and is hence is supported by a number of wires. Track 31 also extends crosswise to the length of a divider, the track and divider feet being structured for releasable sliding engagement. To this end, track 31 has an elongated flat platform 33 from the upper surface of which projects a lengthwise extending rail 35 of e. g. narrow "T" shape. For cooperation with the rail, the divider feet 29 while retaining the original triangular (in end elevation) contour are developed into an inverted "U" shaped clip for "snapwise" pinching engagement with the flanges of the rail.

The inverted "U" shape can be achieved simply by means of an upwardly directed U-shaped recess (not shown) cut into the bottom edge of an end portion 21, 23 of a divider section just inwardly of a triangular foot with the sides of the recess (one of which is the triangular foot) carrying mutually directed lips to clasp the flanges of the rail. A more durable and preferred design adds to the triangular foot a generally parallel inner branch 37 joined to the plane of the foot about halfway up its height by a horizontal shoulder 39. Both branch and shoulder have a lateral thickness conforming (when viewed in end elevation) to the triangular contour of the foot, thus giving to the branch a trapezoidal shape, as suggested in FIG. 4. In side elevation, the modified "clip-like" foot has roughly an "h" shape.

The extreme ends of the legs of the "h" carry mutually facing notches 41 for receiving the rail flanges and those ends can be enlarged for greater strength and durability into horizontal lips 43 and 47, respectively. These lips also create a greater area of contact with the supporting surface when the divider is used in a stand-alone situation and thereby contribute to greater vertical stability. The interior opening 47 of the "h" is given enough vertical height as to allow the triangular foot 29 (the long outer leg of the "h") to exercise a slight resilience perpendicular to its own plane toward and away from the branch 37 (the short inner leg), thereby permitting the modified foot to snap onto and off of the rail and to clamp the flanges of the rail between the opposed notches 41. As can be best seen in FIG. 5, the notches 41 are of relatively shallow V configuration suitable for ready release of the flanges of rail 35 when the divider is pivoted upwardly about a corner or tilted sideways out of its own plane.

Although a track can be provided for each end of the divider, this is not necessary as solid support is achieved with a track at only one, i. e. the inner end. In this arrangement, the track is in an out-of-the-way location deep in the interior of the freezer cabinet or other storage unit and offers minimum inference with the contents of the cabinet. The divider while clampingly engaged on the rail of track 31 is free to slide laterally from one location to another (indicated by the arrow in FIG. 4) as dictated by changes in the display of goods being sold. As explained, the combination of FIGS. 4 and 5 is especially designed for the peculiar requirements of a grid-type shelf; it is not, however, restricted to this environment but can be used to good advantage with a standard solid surface shelf or the like. Moreover, as has been implied above, the divider is fully capable of use as a stand-alone unit free of the track 31.

Figure 6:
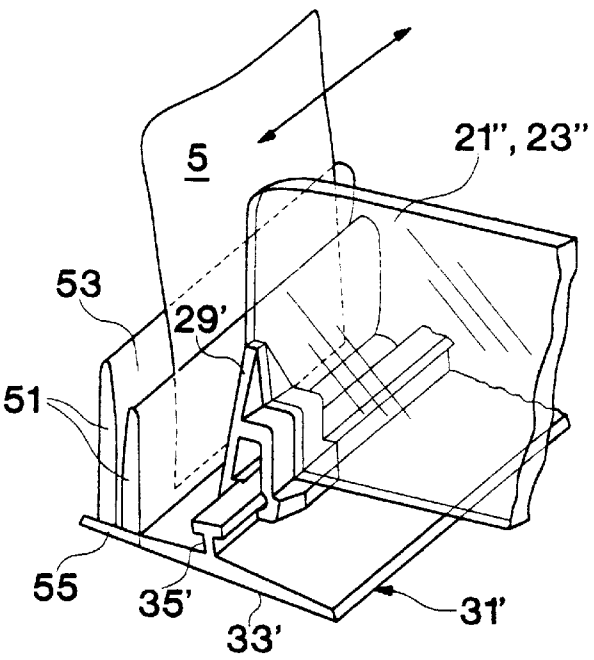
FIG. 6 is a fragmentary perspective view similar to FIG. 4 of another modification in which the adjustment track includes a pair of upwardly directed resilient flexible leaves flaps aligned in slightly laterally spaced apart parallel relation with the track length which are adapted to retain therebetween a sales indicia sheet or other informational material, a portion of which is shown.

A variant of the combination of FIGS. 4 and 5 is depicted in FIG. 6 which is a fragmentary perspective similar to FIG. 4. The components of this variant are the same as in the initial combination including the divider section 21", 23", the clip-like stabilizing foot 29', the track 31', base 33', and rail 35' for clamping engagement by foot 29. The outer side of the track 31 (relative to the divider), however, is extended sideways (of its own length) outside of the end limit of the divider section, as at 55, and is provided with two upstanding closely spaced parallel flexible leaves or flaps 51. Where it is desired for the price or other marketing information to be displayed in proximity to the product to which it is applicable, a price label, sign or information sheet S can be inserted between flaps 51 and retained there by the resilience of the flaps in readily visible position. Flaps 51 have sufficient thickness to be self-supporting in upright condition and are preferably tapered adjacent their free upper end to form a flaring mouth 53 and facilitate insertion of the label or sheet S.

It will be understood that the invention is not limited to the particular embodiments that have been described or to the details of those embodiments. For example, the divider has been described with only two sections but it is obvious that for relatively deep shelf surfaces, the divider could have three or more sections with a tongue and slot connection between each adjacent pair of such sections. Similarly, while the two sections have been described with a single tongue and slot connection, if the divider height is increased sufficiently, it might be desirable to add another such connection at a higher locus. Consequently it is intended to encompass these and all other variations and modifications that fall within the reasonable scope of the appended claims.

Having described the invention, that which is claimed is:

1. An adjustable shelf divider comprising at least two elongated panel sections arranged in co-planar relation to form together a partition for separating groups of products displayed on a generally horizontal shelf surface, said panel sections being connected together by an elongated longitudinal telescoping tongue and slot connection between adjacent ends of said panel sections, said tongue projecting from one section and the slot being formed in the other section, to permit the sections to be extended lengthwise apart to accommodate to different shelf widths while remaining connected together in said co-planar relation, said tongue and slot having pairs of upper and lower edge surfaces in close proximity, each said pair of edge surfaces being shaped with a groove and protrusion for mating lengthwise slidable engagement for retaining said tongue in said slot, and a stabilizing foot adjacent an outer end of each said panel section and extending laterally on opposite sides of such section for contact with said shelf surface to maintain the connected together sections in upright generally vertical condition on said shelf surface, wherein the slot of said tongue and slot connection is defined between two generally parallel vertically spaced apart longitudinal legs extending along an end portion of one section and on each of the opposite sides of said leas a reinforcing strap is affixed at its ends to corresponding sides of said two legs adjacent free ends thereof to thereby bridge between the spaced apart legs, the two straps preventing said legs from moving vertically out of parallel relation while defining therebetween a narrow vertical channel for reception of the tongue of the other section.

2. A shelf divider as in claim 1 wherein each said foot is generally in the shape of a triangle affixed to a lower outer corner of each divider section, the base of said triangle being disposed for supporting contact wits said shelf surface.

3. A shelf divider as in claim 2, wherein said triangle is a substantially isosceles triangle bisected by the divider section to which it is affixed.

4. A shelf divider as in claim 1 in combination with a cooperating elongated track arranged adjacent an outer end of at least one section of the divider in perpendicular relation to the divider length and having a generally flat base for resting contact on said shelf surface and an elongated rail upstanding from said base, and wherein the stabilizing foot adjacent said outer end is bifurcated in the length direction of the divider to define an inverted substantially U-shaped recess for releasable clamping engagement with said rail permitting bodily sliding movement of the divider along the length of the track to change the location thereof lengthwise of the shelf.

5. A shelf divider-track combination as in claim 4 wherein said rail is of generally T-shape with lateral flanges and the bifurcations of said foot have adjacent their lower ends mutually opposed notches for clamping engagement with the rail flanges.

6. A shelf divider-track combination as in claim 4 wherein the base of said track is extended laterally of the track length beyond the outer end limit of the divider section when engaged on the rail of the track and means are on the extended base for receiving a descriptive sign or the like.

7. A shelf divider as in claim 1 wherein said other section is provided with shoulders extending angularly above and below said tongue at the base thereof for abutting contact with the free ends of said legs on said one section and said tongue has a free end which makes abutting contact with an inner end of said slot when said tongue and slot connection is in fully telescoped condition.

8. A shelf divider as in claim 6 wherein said sign-receiving means extends generally at an angle to the plane of the divider.

* * * * *